US007086101B2

(12) United States Patent
Welch et al.

(10) Patent No.: US 7,086,101 B2
(45) Date of Patent: Aug. 8, 2006

(54) INFANT CO-SLEEPER METHOD OF BREASTFEEDING

(76) Inventors: Lisa Welch, 1510 Guerrero St., San Francisco, CA (US) 94110; Viktor Nehring, 1510 Guerrero St., San Francisco, CA (US) 94110

( * ) Notice: Subject to any disclaimer, the term of this patent is extended or adjusted under 35 U.S.C. 154(b) by 0 days.

(21) Appl. No.: 10/876,289

(22) Filed: Jun. 23, 2004

(65) Prior Publication Data

US 2005/0011008 A1 Jan. 20, 2005

Related U.S. Application Data

(60) Provisional application No. 60/487,362, filed on Jul. 15, 2003.

(51) Int. Cl.
*A47C 21/08* (2006.01)

(52) U.S. Cl. ..... 5/428; 5/427; 5/425

(58) Field of Classification Search ..... 5/425, 5/427, 428, 485

See application file for complete search history.

(56) References Cited

U.S. PATENT DOCUMENTS

| | | | | |
|---|---|---|---|---|
| 274,467 | A | 3/1883 | Comins | |
| 2,401,605 | A | 6/1946 | Boren | |
| 2,629,884 | A | 3/1953 | McMonagle | |
| 3,383,718 | A | 5/1968 | Spencer | |
| 3,466,678 | A | 9/1969 | Glaser | |
| 4,607,402 | A * | 8/1986 | Pollard | 5/425 |
| 4,754,509 | A * | 7/1988 | Pollard | 5/425 |
| 5,165,130 | A * | 11/1992 | Wendling | 5/655 |
| 5,193,238 | A | 3/1993 | Clute | |
| 5,351,348 | A * | 10/1994 | Beger | 5/420 |
| 5,359,739 | A * | 11/1994 | Rains et al. | 5/81.1 R |
| 5,367,730 | A | 11/1994 | Sher | |
| 5,530,974 | A * | 7/1996 | Rains et al. | 5/81.1 T |
| 6,536,057 | B1 * | 3/2003 | Fennell et al. | 5/632 |

* cited by examiner

*Primary Examiner*—Frederick L. Lagman

(57) ABSTRACT

An infant co-sleeper has a central cloth bedding portion defining a generally rectilinear area for receiving an infant and two pockets on opposite sides of the generally rectilinear area for receiving removable padding to form barriers on either side of the generally rectilinear area for confining an infant there between. First and second removable padding member are received in the pockets of the central cloth bedding portion to maintain an infant on the central cloth bedding portion. The generally rectilinear area of the co-sleeper can itself define a pocket for receiving backing materials such as absorbent or reinforcing pads. A process of breast feeding the confined infant from the co-sleeper is disclosed where the head of an infant in the co-sleeper is placed adjacent the breast of a nursing human and the padding partially withdrawn to provide infant access to the nursing breast while still confining the infant to the co-sleeper.

1 Claim, 3 Drawing Sheets

INFANT CO-SLEEPER METHOD OF BREASTFEEDING

CROSS-REFERENCES TO RELATED APPLICATIONS

This disclosure claims priority from U.S. Provisional Patent Application Ser. No. 60/487,362 filed Jul. 15, 2003 entitled INFANT CO-SLEEPER AND BREASTFEEDING AID.

STATEMENT AS TO RIGHTS TO INVENTIONS MADE UNDER FEDERALLY SPONSORED RESEARCH AND DEVELOPMENT

Not applicable

REFERENCE TO A "SEQUENCE LISTING," A TABLE, OR A COMPUTER PROGRAM LISTING APPENDIX SUBMITTED ON A COMPACT DISK

Not applicable

This disclosure relates to an improved infant co-sleeper designed to encourage breastfeeding.

BACKGROUND OF THE INVENTION

There is a need for an infant co-sleeper that is easy to use, easy to manufacture, and supportive of breastfeeding mothers.

Infant sleepers are well known in the art. The most common are in the shape of a crib, bassinet or the like, such as those shown in, for example, U.S. Pat. Nos. 274,467; 2,401,605; 3,383,718; and 3,466,678. These sleepers typically are for use alongside a bed. As a breastfeeding aide they are certainly better than a full crib. They are too big to be used in some bedrooms and/or may form an obstruction.

Other sleepers that may be used in bed are along the lines as the one described in U.S. Pat. No. 5,193,238 to Clute, which is comprised of a complicated system of triangular pillows strapped together for the purpose of keeping a sleeping infant on his side. Its purpose is to keep an infant generally stationary. This type of device helps prevent SIDS by immobilization and either requires the complex joining of pillows with fastening strips or the placement of abutments on a plane. The child is not free to move. Devices such as these are not practical for breastfeeding mothers due to the complicated use of straps.

U.S. Pat. No. 5,367,730 to Sher consists of two support cushions placed upon a planar surface. The cushions are attached to the surface with hook and eye fasteners. A big drawback to this design is that the noise made while moving or adjusting a cushion could wake a sleeping baby, and in any case, the cushions are locked into place and are inflexible. They don't have any "give".

U.S. Pat. No. 2,629,884 to McMonagle describes a simple device that solves many of the problems faced by a co-sleeping, breastfeeding mother. The device uses rigid tubes attached to a pad. The tubes form an abutment that keeps an infant from rolling off of whatever surface the pad is place upon. However, the tubes must be inflated—impractical in the middle of the night after deflation for a feeding. Additionally the tubes can easily get punctured, and one must a have a ready replacement or the device is no longer useful.

BRIEF SUMMARY OF THE INVENTION

An infant co-sleeper has a central cloth bedding portion defining a generally rectilinear area for receiving an infant and two pockets on opposite sides of the generally rectilinear area for receiving removable padding to form barriers on either side of the generally rectilinear area for confining an infant there between. First and second removable padding members are received into the two outside pockets of the central cloth bedding portion to maintain an infant on the central cloth bedding portion. The generally rectilinear area of the co-sleeper can itself define a pocket for receiving backing materials such as absorbent or reinforcing pads. A process of breastfeeding the confined infant from the co-sleeper is disclosed where the head of an infant in the co-sleeper is placed adjacent the breast of a nursing human and the padding partially withdrawn to provide infant access to the nursing breast.

James J. Mc Kenna Ph. D., the director of the of the Mother-Baby Behavioral Sleep Laboratory at the University of Notre Dame has documented the healthful and symbiotic relationship of co-sleeping and breastfeeding, describing it as "a mutual reinforcing system." While the practice of breastfeeding is widely embraced, the concept of "co-sleeping" is new to us in name, but not in practice. Co-sleeping is a broad term most commonly used to describe the practice of parents sharing their bed with their child. Several academic studies have shown that there are many physiological and psychological benefits to co-sleeping for both mother and baby, one of which includes prolonging the length of time that mothers breastfeed their infants.

However, in our research with new parents, we have found a reluctance to co-sleep as a proactive parenting practice for any of several reasons. Some parents feel it is just not comfortable to sleep with a baby in an adult bed. Some have a cultural bias against the practice. Others cite subtle peer pressure—"my parents did not do it and neither do my friends." Thus, these parents will have the baby in a crib across the room or even in another room. These solutions make nighttime feedings a chore and create problems that leave many parents, and specifically mothers, feeling like they have to make a choice between breastfeeding their baby or having a good night's sleep. Nighttime breastfeeding and getting a good night's rest do not have to be at odds. Because we are strong believers in the health benefits of breastfeeding, and because we believe a good night's rest is a cornerstone of being a good parent, we have developed a co-sleeping product that will encourage parents to breastfeed longer without sacrificing sleep.

We have designed a co-sleeper as a solution to help parents co-sleep comfortably in order to encourage the healthful practice of breastfeeding. There is currently no product on the market that addresses both of these concerns in a single design

DETAILED DESCRIPTION OF THE INVENTION

Figure 1:
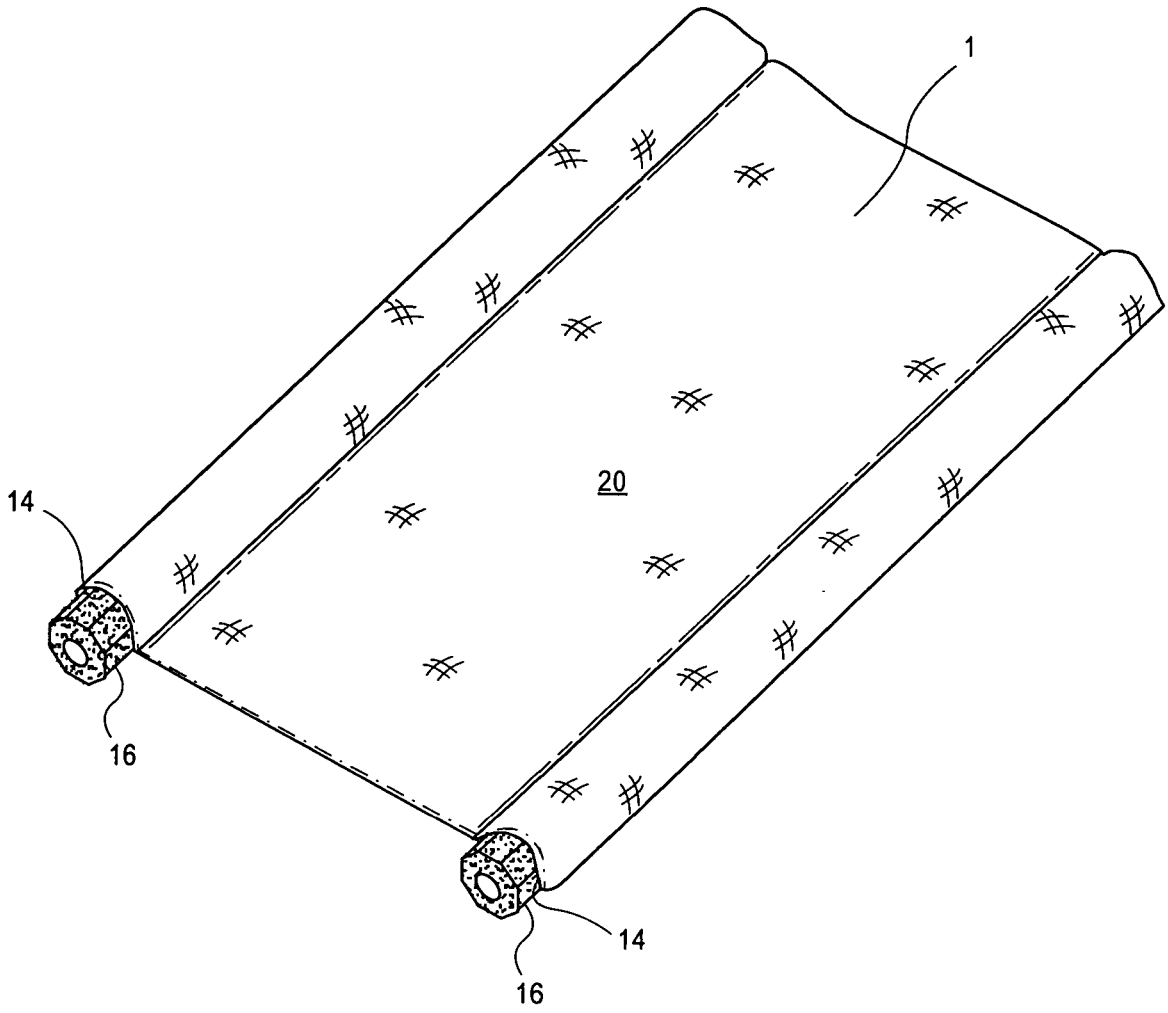
FIG. 1 is a perspective illustration of the infant co-sleeper in a bed.
Figure 2:
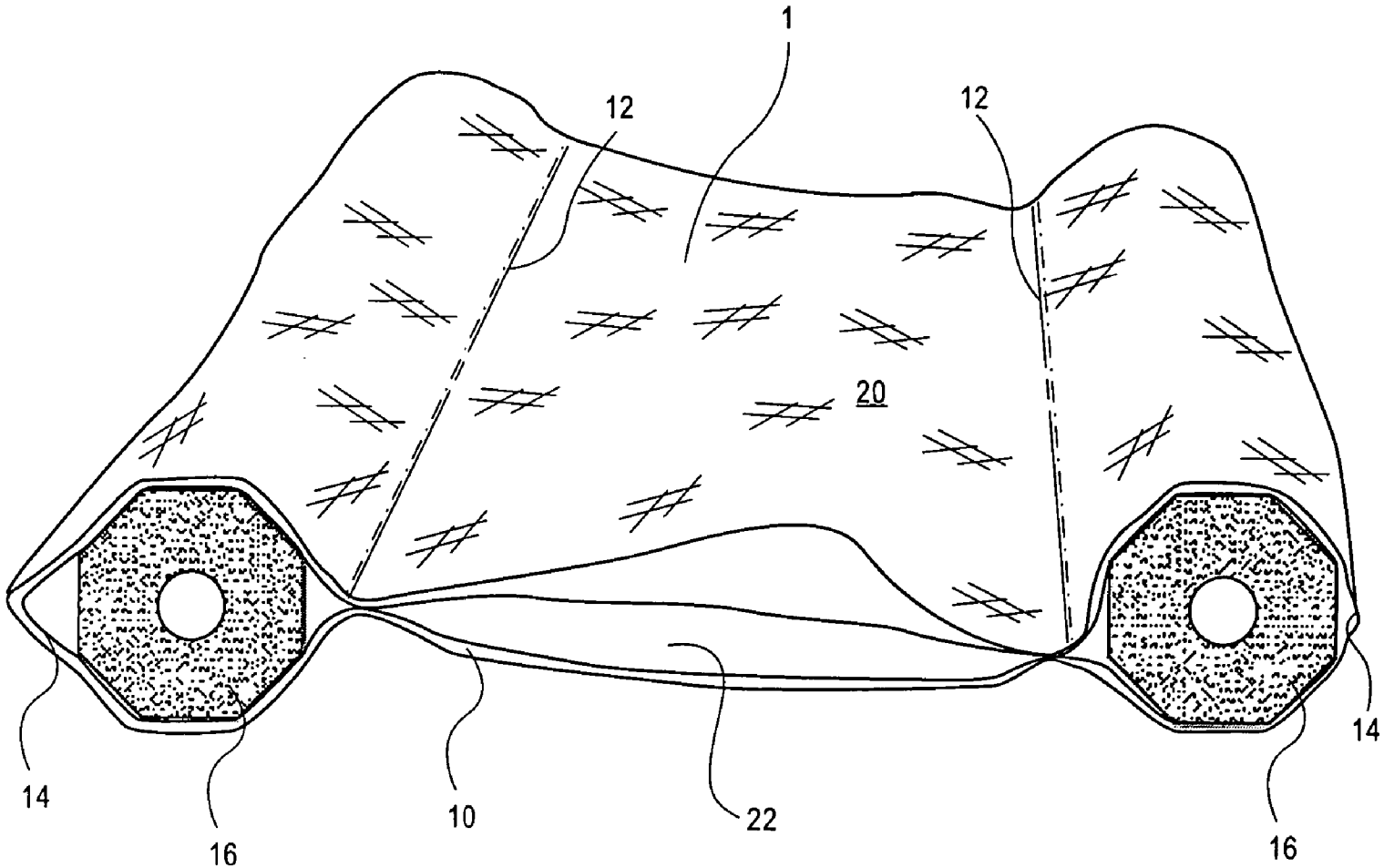
FIG. 2 is an end view of the co-sleeper illustrating the two occupied side pockets and illustrating the central portion of the co-sleeper for receiving backing or absorbent padding; and, FIG. 3 is a perspective view of one of the padding members being partially withdrawn to provide access between the infant and nursing mother while maintaining the infant safely within the co-sleeper.

Referring to FIG. 1 and 2, the construction of the co-sleeper can be easily understood. Quilted pad 1 is shown formed into an endless two-sided pad 10. Endless two-sided pad 10 is provided with paired seems 12 which define pad receiving pockets 14. Into those respective pad receiving pockets 14 there are placed paddings 16, here in the form of so-called "swimming pool noodles." It will be seen in FIG. 2, that central rectilinear portion 20 formed by quilted pad 1 forms a pocket 22 which can receive backing or absorbent padding [not shown].

Figure 3:
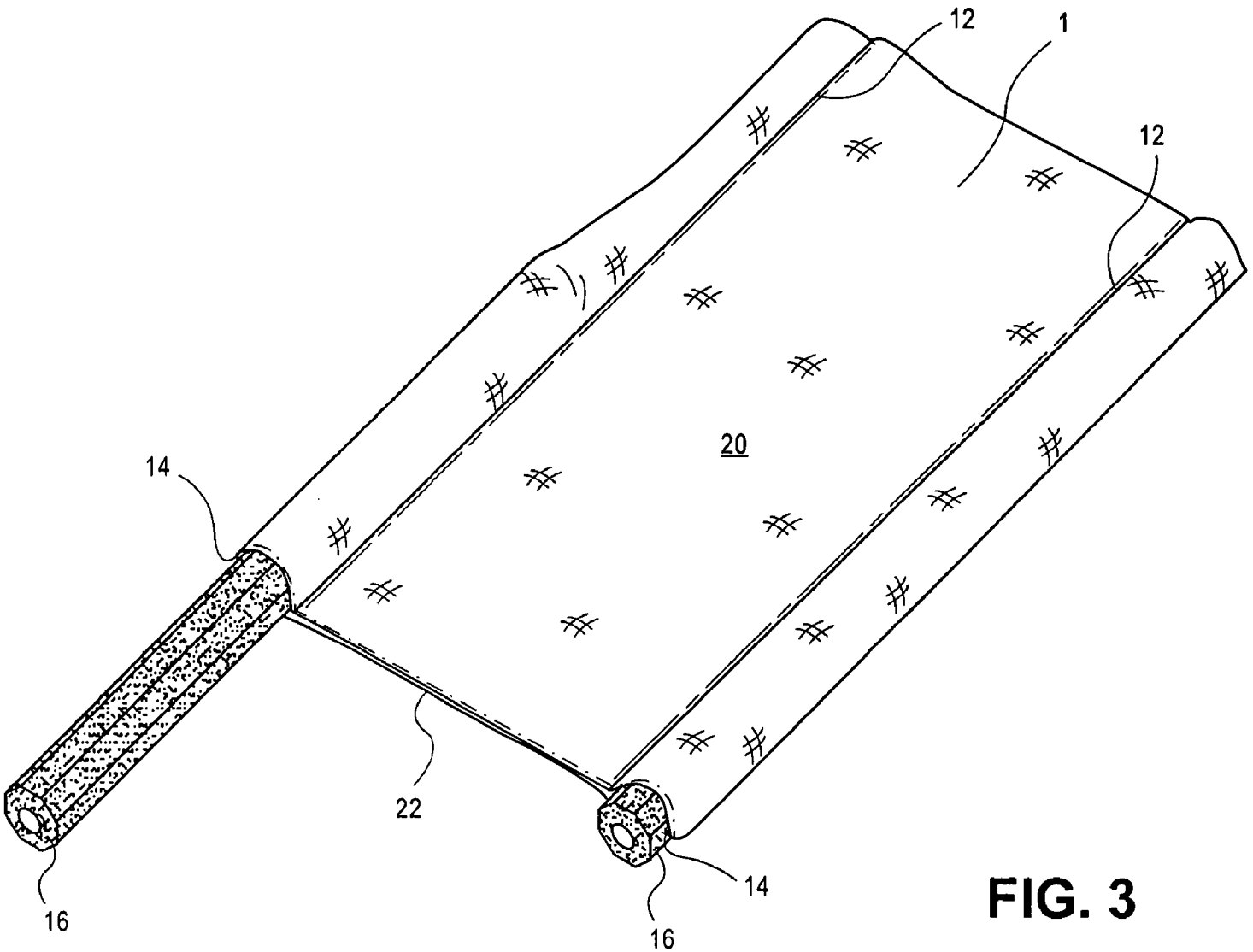

Referring to FIG. 3, use of the infant co-sleeper is easily understood. Simply stated, one padding 16 is withdrawn partially from a pocket 14 to vacate pocket 14 in the vicinity of the infant's head. The infant can then be addressed to the breast of the nursing mother while a portion of padding 16 maintains the capture of the infant on the co-sleeper.

It will be understood that this invention will admit of a wide variety variation. It is important that padding 16 be such that it can be partially withdrawn in easily reinserted into and out of receiving pockets 14 so that breast-feeding can easily occur. Padding 16 will admit of wide variation including conventional pillows and the like. It is important that padding 16 be substantial to enable both capture of the infant as well as to provide a tactile indication of boundary to sleeping parents.

What is claimed is:

1. A process of breastfeeding an infant from an infant co-sleeper from the breast of a nursing human comprising the steps of:

providing an infant co-sleeper having a central cloth bedding portion defining a generally rectilinear area for receiving an infant;

two pockets on opposite sides of the generally rectilinear area for receiving removable padding to form barriers on either side of the generally rectilinear area;

a first removable padding member for being received within one of the pockets of the central cloth bedding portion; and a second removable padding member for being received within the other of the pockets of the central cloth bedding portion;

placing said first and second removable padding members within opposite pockets of the central cloth bedding portion to form a barrier on either side of the generally rectilinear area to maintain an infant on the central cloth bedding portion between opposite barriers;

placing an infant on the co-sleeper;

placing the head of an infant adjacent one of the pockets and adjacent the breast of a nursing human; and at least partially withdrawing the removable padding member in the vicinity of the head of the infant from the pocket to collapse the barrier and allow the infant access for nursing while confining the infant to the co-sleeper.

* * * * *